United States Patent [19]

Lagofun

[11] Patent Number: 4,532,866

[45] Date of Patent: Aug. 6, 1985

[54] COMBUSTIBLE SAFETY PRIMER OF SELECTIVE PERCUSSION FOR CASE-LESS AMMUNITION OR AMMUNITION WITH COMBUSTIBLE CASE

[75] Inventor: Guy J. Lagofun, Tarbes, France

[73] Assignee: L'Etat Francais, Paris, France

[21] Appl. No.: 541,508

[22] Filed: Oct. 13, 1983

Related U.S. Application Data

[63] Continuation-in-part of Ser. No. 322,876, Nov. 19, 1981, , which is a continuation of Ser. No. 61,024, Jul. 26, 1979.

[51] Int. Cl.[3] ..... F42C 19/10

[52] U.S. Cl. ..... 102/204; 102/431

[58] Field of Search ..... 102/430–433, 102/204, 469, 470

[56] References Cited

U.S. PATENT DOCUMENTS

| | | | |
|---|---|---|---|
| 255,822 | 4/1882 | Smoot . | |
| 3,046,891 | 7/1962 | Treat, Jr. . | |
| 3,169,483 | 2/1965 | Gowlick et al. . | |
| 3,311,057 | 3/1967 | Quinlan et al. . | |
| 3,482,516 | 12/1969 | Farmer et al. | 102/431 X |
| 3,486,453 | 12/1969 | Smallwood . | |
| 3,658,008 | 4/1972 | Larson . | |
| 3,777,664 | 12/1973 | Gawlick et al. | 102/204 |
| 3,848,530 | 11/1974 | Plumer . | |
| 3,994,235 | 11/1976 | Palitzer et al. . | |

FOREIGN PATENT DOCUMENTS

| | | | |
|---|---|---|---|
| 2708525 | 8/1978 | Fed. Rep. of Germany | 102/470 |

*Primary Examiner*—Harold J. Tudor

*Attorney, Agent, or Firm*—Parkhurst & Oliff

[57] ABSTRACT

The invention concerns a percussion primer for ammunition without case or ammunition with combustible case of the type comprising a sensitive composition 6 placed against an anvil 7.

The anvil is developed in a combustible block 4 provided with a vent 5 arranged at a conical end of the combustible block 4 and coaxial with a firing pin 3 with flat end firmly connected with the weapon; the anvil is formed of the sharp edge of the conical end of the block defining the vent and fits the shape of the cross section of the firing pin, in order to permit the shearing of the sensitive composition.

The primer in accordance with the invention is of great selectivity and is practically insensitive to accidental percussion.

7 Claims, 7 Drawing Figures

COMBUSTIBLE SAFETY PRIMER OF SELECTIVE PERCUSSION FOR CASE-LESS AMMUNITION OR AMMUNITION WITH COMBUSTIBLE CASE

This is a continuation-in-part of Ser. No. 322,876, filed Nov. 19, 1981, which in turn is a continuation of Ser. No. 61,024, filed July 26, 1979.

The technical field of the present invention is the field of primers for case-less ammunition. More particularly it concerns the fields of completely combustible primers.

Case-less ammunition or ammunition with a combustible case constitute products which comprise a false case made of combustible powder agglomerated by a polymerizable polyurethane binder. This ammunition has the following advantages over the conventional ammunition with metallic or non-combustible case: no any empty case need be removed after firing, a higher rate of firing is achieved, no metal is used in the invention, and the invention utilizes a, smaller loaded weight yet increases the firing capacity for the same weight of ammunition. On the other hand, there are drawbacks to case-less ammunition which recite to the high temperature of reaction, the tendency of the ammunition to self-ignite and the tendency for corrosion to occur in the chamber of the weapon as a result of direct contact of the propulsion gases with the chamber of the weapon.

Case-less ammunition necessarily requires an entirely combustible primer since no solid waste can be tolerated in the weapon. A percussion primer operates under the action of a mechanical blow produced by the firing pin of the weapon. In conventional ammunition, this primer is mounted in a recess provided for this purpose in the base of a tube or of a cartridge case of small or medium caliber and then is crushed against an anvil by the firing pin. This crushing leads to the initiating of the sensitive pyrotechnical composition by a mechanical effect combining impact and friction. The U.S. Pat. No. 3,486,453 for example describes a combustible primer for caseless ammunition comprising a flat anvil, a primer composition which is not in contact with said anvil, and a primer cup mounted on the peripheral surface of the anvil. The initiation of this primer is obtained by crushing the composition with a firing pin having a flat face configuration. It is sometimes stated that initiation is obtained by shearing of the primer composition but it is quite impossible for a person in ordinary skill in the art to obtain shearing with an anvil of flat configuration. Further, no prior art gives any indication or mentions the relationship between the diameters of the firing pin and the flash hole.

It has been found that this manner of initiation is not selective and that the percentage of ammunition initiated accidentally is excessively high.

Electric primers have been proposed in order to increase the reliability of the operation of the ammunition. The main drawback of this type of primer is that it requires an outside source of energy for operation.

Primers operating by dielectric breakdown within the explosive have also been proposed. These primers require an electric arc, the electrodes of which are formed of metallic layers.

Whatever the method for initiation, the art teaches that a primer must have great reliability during use in a weapon and additionally the ability to withstand unexpected shocks for example during the handling of the ammunition. Regarding the percussion primer, the reliability during use in a weapon can be estimated by the height of the fall of a steel ball of mass M falling from a height H on a firing pin so that it will be obtained 99,9% of firing of the primer with a 95% confidence level. The reliability of the compound to withstand the undesigned shocks can be estimated by determining height of the fall of the same ball falling from a height h on the same firing pin so that it will be obtained 99.9% of misfire of the primer with a 95% confidence level. The selectivity of a primer can be defined by the relation (H/n) which is the ratio of the percussion energy (E=Mg H). The smaller this ratio, the greater is the selectivity of the primer. In practice, the selectivity of the known primers is between 2 and 5.

It is well known that when primers with a metallic cap are fired the bottom of the cap is deformed when the primer is crushed against an metallic anvil bonded to the case (BERDAN's method) or integrated in the primer (BOXER's method). For gas tight combustion, it is imperitive to avoid any breaking of the bottom of the cap. The selectivity of this primer type is often greater as 3.

The object of the present invention is to provide for a percussion primer of a new type which makes it possible to obtain a very selective percussion which is practically insensitive to any blow or friction other than those expressly contemplated for its operation.

An object of the present invention is to provide a percussion primer for case-less ammunition or ammunition with combustible case, of the type comprising a sensitive composition placed against an anvil located in a combustible block and having a vent, said block characterized by the fact that the vent is provided at the conical end of the block coaxially situated with a firing pin having a flat end which is integral with the weapon. The anvil has a sharp edge at the conical end of the block defining the vent and fitting the shape of the cross section of the firing pin in order to permit the shearing of the sensitive composition.

The invention is a percussion primer for case-less ammunition or ammunition with combustible case for a weapon utilizing a firing pin, that comprises:

- a combustible propellant block, said block having one end in the form of a conical surface functioning as an anvil and a vent formed in said block;
- a wholly combustible sensitive primer composition;
- and combustible means for holding the primer composition in contact with the conical anvil surface of said block;
- said vent aligned to be coaxial with the firing pin of a weapon in which said ammunition may be fired and extending through the conical end of the block,
- said anvil being defined by the intersection of the conical end of surface of the block and the internal surface of the vent,
- the diameter of the cross section of the firing pin being less than that of said vent so that the clearance in mm between the cross-section and the vent will be $0<\epsilon\leqq 5/10$, and the said primer composition is initiated only by shearing of said primer composition (the compression due to striking by the firing pin being negligible).

One object of the instant invention is that the primer is selectively initiated by shearing and not by crushing as in the case of conventional firing pins. As a matter of fact, the use of a firing pin with a flat end cooperating with the sharp edge constituting the anvil produces an annular friction causing a rupture of the sensitive composition at the place of the firing pin. Thus the initiation is effected only by a flat-end firing pin whose cross section of which is adapted to that of the anvil for a predetermined intensity of percussion.

The shape of the cross section of the firing pin may be any shape whatsoever, for instance cylindrical, square, triangular, etc. The size of the cross section of the firing pin is substantially less than that of the vent.

Preferably a cup is employed which has a surface of lesser resistance (than other surfaces of the cup) facing the firing pin. The blow of the firing pin therefore brings about the rupturing of this surface and this friction results in the shearing of a part of the sensitive composition at the location of the firing pin.

Preferably the insensitivity of the primer to an accidental impact is increased by reinforcing the bottom of the cup and providing therein a blind hole in which the firing pin engages before the percussion of the pin. This structure furthermore makes it possible to decrease the dynamic rebound effects which may cause abnormal wear of the breech of the weapon due to the distance of the sensitive composition from the breech. Furthermore, complete gas-tight combustion can be obtained by providing a blind hole of small clearance around the firing pin at the moment of the percussion. This mat therefore functions to preventing direct contact between the combustion gases of the primer and the firing pin of the weapon, thereby increasing the life of the weapon.

The invention will be better understood in the light of the following description with various embodiments, read in conjunction with the accompanying drawings, the said description and drawings being given solely by way of illustration and not of limitation.

Figure 1:
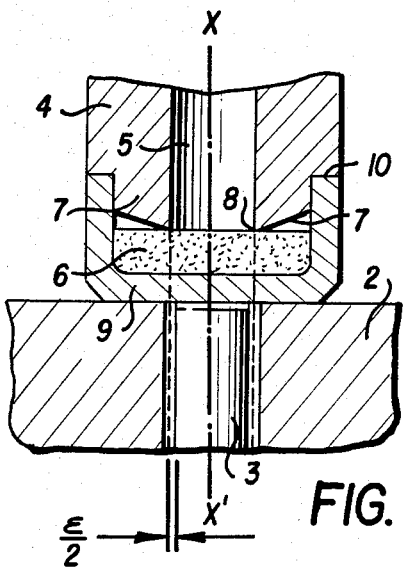
FIG. 1 is a diagrammatic view of one embodiment of the primer in accordance with the invention.

FIG. 1 illustrates the rear portion 1 of an ammunition placed in the breech 2, of a weapon shown in part, said weapon having a; firing pin 3. The rear end 4 of the combustible block of the ammunition is provided with a vent 5 the function of which is to assure a larger surface of contact between the gases generated by the ignition of a sensitive composition 6. This composition 6 is placed against an anvil 7 formed of the conical end of the combustible block. This anvil has a sharp edge 8 which is intended to constitute a conterpart for the firing pin. A combustible cup 9 is arranged against the composition 6 so as to prevent direct action of the firing pin against the composition 6. This cup 9 is fitted over a shoulder 10 of the combustible block and can be glued onto the latter.

EXAMPLE

By way of illustration, a cup with a bottom of a thickness of 2 mm can be force-fitted, centered and glued over a shoulder 10 with a diameter of 8 mm. The outside diameter of the cup and of the combustible block is 10 mm; the diameter of the vent is 4 mm and the conical surface of the anvil defines an angle close to 120° with a generatrix of the ammunition.

The sensitive composition used is as follows,

44% lead trinitroresorcinate
5% tretazene
40% barium nitrate
11% antimony sulfide.

The weight of the composition is 0.15 g.

The firing of the composition is effected by means of a steel firing pin with a flat end of a diameter of about 3.5 mm, and which can be protruded from the breech of the weapon by 8 mm. The blow of the firing pin against the bottom of the cup is transformed into annular friction and results in the shearing of the sensitive composition.

Figure 2A:
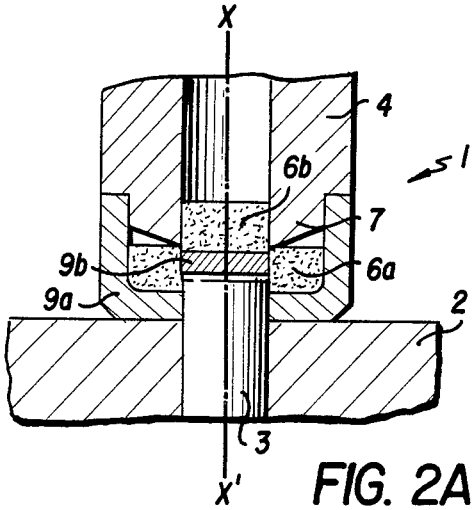
FIGS. 2A and 2B are diagrammatic views of a primer in accordance with the invention just after percussion and at the time of the initiation of the sensitive composition respectively.
Figure 2B:
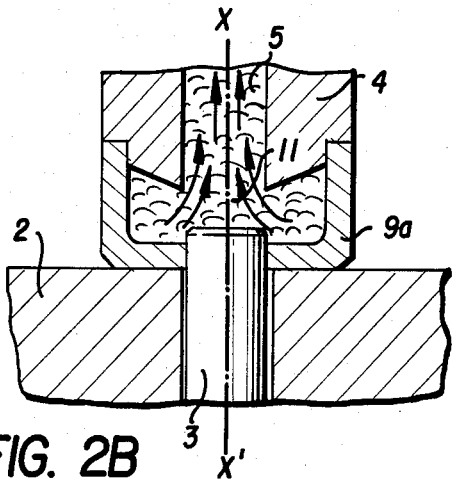

The firing sequence as shown on FIGS. 2A and 2B involves a wherein the firing pin 3 with a flat end strikes the cup 9 and sheares this cup into parts 9*a* and part 9*b* and sheares the composition 6 into parts 6*a* and 6*b* (FIG. 2A). During this shearing, part 6*a* rubs against part 6*b* and allows the initiation of the composition to occur.

FIG. 2B shows diagrammatically the final position of the firing pin 3 after percussion. The gases produced by the combustion of the sensitive composition spread out in the vent 5 igniting the combustible block 4 along its inner surface defined by the vent.

Figure 3:
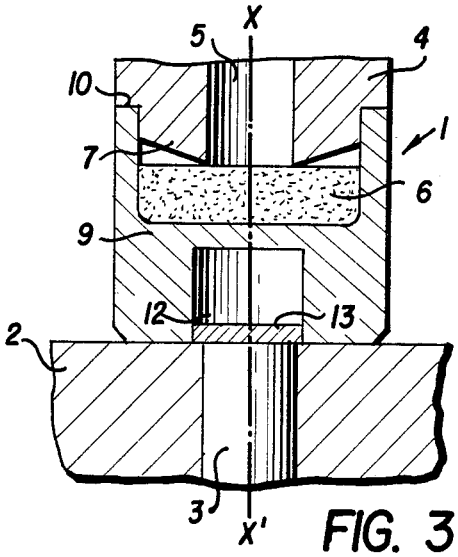
FIGS. 3 and 4 are diagrammatic views of another embodiment of a primer in accordance with the invention before percussion and at the moment of the commencement of percussion, respectively.
Figure 4:
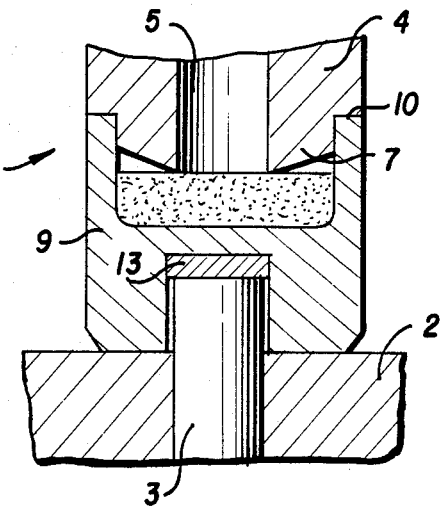

FIGS. 3 to 4 show other embodiments in which the reference numerals indicate the same parts. In FIG. 3 the cup 9 is shown provided with a thick bottom within which a blind hole 12 is provided. The blind hole serves as a percussion well into which the firing pin must necessarily penetrate. The diameter of this well is slightly greater than that of the firing pin so as to assure a very slight clearance. A mat 13 of combustible plastic material assures the plugging of the percussion well and also acts as a joint around the firing pin so that at the moment of the firing, the mat protects the pin from the combustion gases of the primer. This mat 13 may be of celluloid or cellulose acetate and be 0.2 mm thick. This mat may be preformed for partial or total penetration into the percussion well.

FIG. 3 shows the position of the firing pin 3 of the weapon before the firing and FIG. 4 shows the position of this firing pin at the moment of the start of the percussion. The drawings show that the percussion takes place only in the event that the firing pin is aligned on the axe x—x′ axis with the blind hole 12. The small clearance of this firing pin with respect to the blind hole makes the primer practically insensitive to any accidental percussion.

In the preceding embodiments, a firing pin and a vent are illustrated as bodies of cylindrical revolution around the x—x′ axis,. However, this shape is by no means necessary; rather the shape may be any whatsoever. The firing pin could, for instance, be of cruciform cross section.

Figure 5:
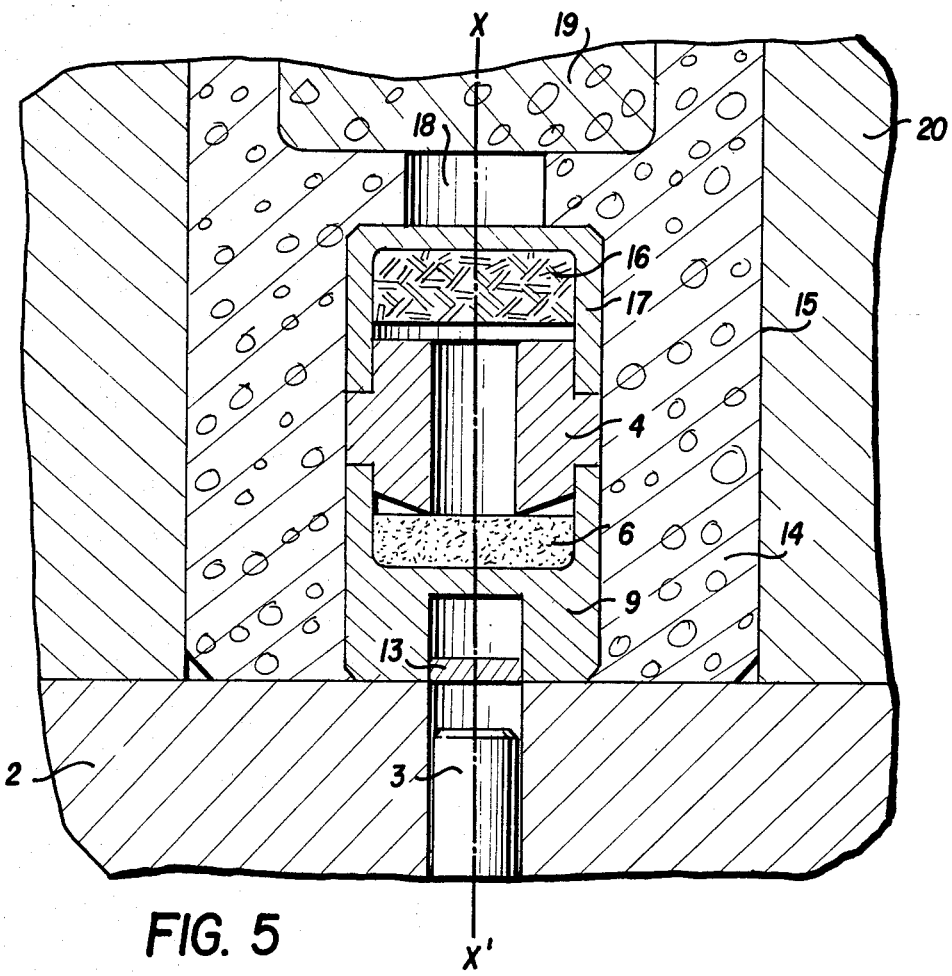
FIG. 5 shows the integration of a primer according to the invention in a caseless ammunition.

In the preferred embodiment, the primer as shown in FIG. 5 is in an ammunition with a combustible case. The primer is integrated at the rear end 14 of a combustible case in the hole 15. The primer comprises a reinforced composition 16 placed in a combustible cup 17 fitted on the front part of the block 4. The composition 16 is somewhat spaced from the block 4 and the cup 17. The blind hole 18 is arranged in the case facing the propellant charge 19. The ammunition is placed in the tube 20, against the breach 2 in the partially represented weapon.

The selectivity of the primer in accordance with the invention, was tested by evaluating the energy needed to initiate the primer through subjecting the primer to percussion by a steel ball of 525 g dropping by gravity onto the firing pin. The following results were obtained:

Energy with 90% operation: 2.5 joules, height of fall 500 mm

Energy with 99% misfires: 1.5 joules, height of fall 250 mm

These heights of fall and energy requirements clearly show the high level of reliability of the primer in accordance with the invention and that the ratio of selectivity is equal to 1.6 (2.5/1.5).

Figure 6:
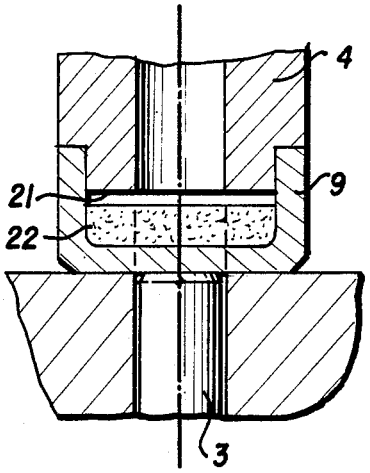
FIG. 6 shows a conventional primer for comparaison with the invention.

For purpose of comparison with a primer comprising flat anvil and wherein firing is obtained by crushing, primers according to FIG. 6 have been tested. The primer of FIG. 6 is identical to primer of the instant invention except in regard to the configuration of the anvil. the anvil of the prior art comprises, in particular, a flat anvil 21 spaced apart from the primer composition 22. The nature of the different parts of this primer is the same as those of the primer according to FIG. 1.

The reliability of the prior art primer is measured by the Bruceton's method in which a steel ball of 240 g falls on a firing pin with a flat end arranged against the cup. The height of fall is the parameter of sensitivity or reliability. Accordingly the height ($h_m$) gives 50% of fire and scattering ($\sigma$), the height of reliability ($h_s$) with 99.9% of misfire, the height of firing ($h_f$) with 99.9% of firing are measured and the selectivity $S = hf/h_s$ is calculated:

| Primer | $h_m$ (mm) | $\sigma$ | $h_s$ (mm) | $h_f$ (mm) | S |
|---|---|---|---|---|---|
| Invention | 372 | 0,025 | 311 | 444 | 1,43 |
| Known primer (FIG. 6) | 410 | 0,048 | 292 | 575 | 1,97 |

The primer according to the invention is more sensitive than the known primer and the scattering is smaller (fast twice smaller in logarithm value). This great reduction of gives a better selectivity of the primer. This result is probably due to the structure of the primer wherein the percussion energy is centered on the sheared annular section of the primer composition, as delineated by the pin surface and the conical end of the anvil. The selectivity of the primer is then improved. Undoubtedly the selectivity of the primer according to the invention is far greater than the selectivity of the primer described in the known art.

Of course, the device in accordance with the invention as described can be developed in accordance with numerous variants within the scope of the one skilled in the art. For example, the vent may be extended up to a cavity which contains an intensifying composition of a known type. The power, the sensitivity and the dimensions of the primer may be any whatsoever. Finally, the nature of the components of the primer may be modified.

I claim:

1. A percussion primer for case-less ammunition or ammunition with combustible case for a weapon utilizing a firing pin with a flat end, comprising:

a combustible propellant block, one end of which is in the form of a conical surface for functioning as an anvil and a vent formed in said block;

a wholly combustible sensitive primer composition;

and combustible means for holding the primer composition in contact with the conical anvil surface of said block;

said vent aligned to be coaxial with the firing pin of a weapon in which said ammunition may be fired and extending through the conical end of the block;

said anvil being defined by the sharply edged intersection of the conical end of the conical end surface of the block and the internal surface of the vent; and the diameter of the cross section of the flat ended firing pin being less than that of said vent so that the clearance in mm between them will be $0 < E \leqq 5/10$ so that the initiation of said primer composition is obtained substantially only by shearing of said primer composition.

2. A primer as claimed in claim 1, wherein said means for holding is a combustible cup which is fitted onto a shoulder of said combustible block, said cup being capable of isolating said firing pin from said primer.

3. A primer as claimed in claim 1, wherein said cup is provided with a blind hole in substantial alignment with said firing pin to receive said firing pin.

4. A primer as claimed in claim 3, wherein said blind hole is a hole of cylindrical shape formed around the axis of the ammunition.

5. A primer as claimed in claim 4, wherein said blind hole has a cross-sectional shape similar to that of said firing pin and said blind hole has a diameter greater than that of said firing pin, to allow free penetration of said pin.

6. A primer as claimed in claim 4, further comprising a combustible mat which closes said blind hole.

7. A primer as claimed in claim 1, wherein the angle formed by the generatrix of the ammunition and the conical surface of said block is about 120°.

* * * * *